US009287029B1

(12) United States Patent
Colich

(10) Patent No.: US 9,287,029 B1
(45) Date of Patent: Mar. 15, 2016

(54) MAGNET ARRAYS

(71) Applicant: Dragoslav Colich, Huntington Beach, CA (US)

(72) Inventor: Dragoslav Colich, Huntington Beach, CA (US)

(73) Assignee: AUDEZE LLC., Costa Mesa, CA (US)

( * ) Notice: Subject to any disclaimer, the term of this patent is extended or adjusted under 35 U.S.C. 154(b) by 0 days.

(21) Appl. No.: 14/498,992

(22) Filed: Sep. 26, 2014

(51) Int. Cl.
*H01F 7/02* (2006.01)

(52) U.S. Cl.
CPC ..... *H01F 7/0278* (2013.01); *H01F 7/0289* (2013.01)

(58) Field of Classification Search
CPC ..... H01F 7/0284; H01F 7/0289; H01F 7/02; H01F 7/0205
See application file for complete search history.

(56) References Cited

U.S. PATENT DOCUMENTS 4,185,262 A * 1/1980 Watanabe ..... H01F 41/028 335/302
4,536,230 A * 8/1985 Landa ..... H01F 7/021 148/300
2002/0075110 A1* 6/2002 Shimizu ..... H01F 7/0284 335/252
2012/0092103 A1* 4/2012 Roberts ..... H01F 7/0284 335/295
2012/0262019 A1* 10/2012 Smith ..... H02K 1/2766 310/156.07
2012/0262261 A1* 10/2012 Sarai ..... H01F 7/02 335/306

* cited by examiner

*Primary Examiner* — Mohamad Musleh
(74) *Attorney, Agent, or Firm* — Robert D. Becker; Manatt, Phelps & Phillips

(57) ABSTRACT

An array of paired bar magnets (200) provides a reinforced magnetic field (203) on a first side and a nearly canceled magnetic field (204) on a second side of each pair. The array may be a planar array (600) with a plurality of parallel, coplanar pairs (620). The array may provide air gaps between consecutive pairs, and within individual pairs, to provide improved transparency to sound. The array may be doubled (700), with the reinforced fields (713) of one half of the array opposing the reinforced fields (723) of the other half to produce a more intense field (730). In another configuration, the array may be doubled (800) with the nearly canceled fields of one pair facing the nearly canceled fields of the other, producing an array with reinforced fields (801-804) on four sides.

10 Claims, 3 Drawing Sheets

MAGNET ARRAYS

FIELD OF THE INVENTION

The present invention and embodiments thereof relates generally to arrays of permanent magnets and more specifically to arrays wherein the magnetic axes of the individual magnets are oriented to be strictly oblique to the axes of the array in cross-section.

BACKGROUND OF THE INVENTION

Typically, planar magnetic acoustic transducers use a flat, lightweight diaphragm suspended in a magnetic field, rather than a cone attached to a voice coil. The magnetic field is typically produced by a planar array of bar magnets, the bar magnets spaced apart regularly, but aligned parallel to each other, the poles of the bar magnets oriented to be perpendicular to the layer the magnets form. The diaphragm is suspended above the magnets, and substantial portions of the electrically conductive circuit pattern run parallel to individual bar magnets, as when current passes through these portions of the circuit, an induced magnetic field will react with the field produced by the magnets, causing the conductor, and the attached diaphragm, to be drawn to or away from the magnets.

However, there are drawbacks to the magnetic arrangement in the classic planar magnetic acoustic transducer design. In simple configurations, the magnetic field imposed by the array of bar magnets not only permeates the volume in which the diaphragm operates, but also imposes a like-intensity magnetic field on the opposite side of the array. In most applications this opposite side magnetic field is wasted. In a more sophisticated configuration, a stator is applied on the backside of the array, to contain and redirect the opposite side magnetic flux to bolster the field acting on the diaphragm. The added mass of the stator is a drawback to this configuration, as is increased impedance to the passage of sound due to the spaces between bar magnets being covered by the stator, even partially, as when the stator is perforated or consists of separated strips.

Prior art Halbach magnet arrays rely on a cyclical rotation in magnetic orientation from magnet to magnet, as shown in FIG. 1, wherein the magnetic axis of each magnet is 90-degrees further rotated than it's preceding neighbor. For example, in Halbach magnet array 100, shown in cross-section, each consecutive magnet from left-to-right has a magnetic axis that is 90-degrees further counterclockwise than its predecessor, as the axis of magnet 102 is 90-degrees more counterclockwise than magnet 101. The valued property that emerges from this arrangement in Halbach array 100, is that rather than having a symmetrical field evenly distributed on either side of the array, the field 103 on one side is greater than it would be for an traditional array of alternating magnets (which would correspond to magnet 101 and every alternate magnet to either side, with the intervening magnets, e.g., 102, removed). The field 104 on the other side is nearly canceled. As with a stator, in a planar magnetic acoustic transducer application, Halbach arrays suffer from the added magnets (e.g., 102) obstructing the passage of sound. While the property of an intensified field 103 on one side and substantially canceled field 104 on the opposite side makes a Halbach array more efficient in one way, the added weight corresponding to doubling the count of magnets and the obstruction to the passage of sound (even when some of the magnets are drilled through), reduce the effectiveness of Halbach arrays.

Additionally, Halbach arrays are difficult to assemble. The individual magnets are not in equilibrium when arranged as a Halbach array, and the array will collapse into a jumble if not glued or otherwise supported and braced. In some cases, particularly with individual magnets 101, 102 that are strong, manual assembly of the array can be fraught with pinched fingers and frequent starting over again.

A need exists for a magnetic array, having the property of an intensified field on one side and a nearly canceled field on the other, suitable for efficient use in planar magnetic and other acoustic transducers.

OBJECTS AND SUMMARY OF THE INVENTION

Embodiments of the present invention include a magnet array well suited for use in planar magnetic acoustic transducers.

It is an object of embodiments of the present invention to allow a planar magnetic transducer, used as a speaker, to develop more acoustic power than is possible with a particular amount of conductive material on a single diaphragm.

It is an object of embodiments of the present invention to provide a planar magnetic array whose individual magnets form elements that are easy to assemble and when assembled are in substantial mechanical equilibrium without glue.

It is a further object of embodiments of the present invention to provide lightweight planar magnetic elements allowing efficient passage of sound.

It is an object of embodiments of the present invention to provide processes of manufacture for the magnetic elements of these magnetic arrays.

The present embodiments of the invention satisfy these and other needs and provides further related advantages.

BRIEF DESCRIPTION OF THE DRAWINGS

The aspects of embodiments of the present invention will be apparent upon consideration of the following detailed description taken in conjunction with the accompanying drawings, in which like referenced characters refer to like parts throughout, and in which.

While embodiments of the invention will be described and disclosed in connection with certain preferred embodiments and procedures, they are not intended to limit the invention to those specific embodiments. Rather they are intended to cover all such alternative embodiments and modifications as fall within the spirit and scope of embodiments of the invention.

DETAILED DESCRIPTION OF THE INVENTION

Figure 1:
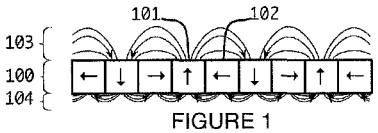
FIGURE 1 (Prior Art)
FIG. 1 shows a cross section of a prior art Halbach planar magnetic array.
Figure 2:
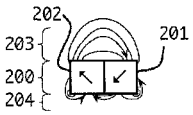
FIG. 2 is a cross-section of a single magnetic array element pair having an intensified magnetic field on one side and a canceled magnetic field on an opposite side.

Referring to FIG. 2, a magnet array 200 comprises a pair of bar magnets 201, 202, shown in cross-section. Each bar magnet 201, 202 is magnetized with a field orientation as shown by the corresponding internal arrow. The combination of the two bar magnets 201, 202 produces a reinforced magnetic field 203 on a first side of the array and a nearly-canceled field 204 on a second, opposite side of the array. In this configuration, the reinforced field 203 is much stronger as the field projected by either bar magnet 201, 202 operating alone. The smaller, nearly-canceled field 204 substantially limits the magnetic influence of the array 200 toward the second side.

Figure 3:
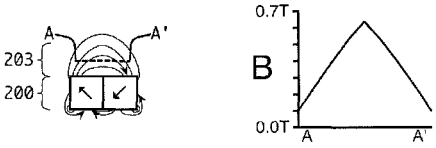
FIG. 3 is a cross-section of the same array of FIG. 2, showing the placement of an acoustic transducer diaphragm and a plot of the magnetic field intensity for that placement.

FIG. 3 shows a plot of the magnetic flux density or magnetic induction B for the reinforced field 203 along the line segment A-A'. The plot shows that the magnetic induction B is most intense along A-A' at the midpoint, and falls off toward either end. When used in a planar magnetic acoustic transducer, a diaphragm located at rest along A-A' would have conductors running perpendicular to the drawing sheet (i.e., with currents flowing into and out of the page). As taught in U.S. Patent Application No. 61/892,431, filed Oct. 17, 2013, and entitled "Thin Film Circuit for Acoustic Transducer and Methods of Manufacture" by Colich, et al., such conductors can be made to have widths varying in proportion to B so that the current density in the conductor is inversely proportional to B, whereby the Lorentz force on each conductor is evenly distributed across the conductor and more generally, across the diaphragm, a configuration that is valuable to minimize distortion in an electro-acoustic transducer.

Figure 4:
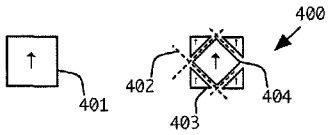
FIG. 4 is a cross-section of bar magnet and the cuts made in one process of forming the magnetic elements of embodiments of the present invention.

FIG. 4 shows one example bar magnet manufacturing process 400 for making the individual magnetic elements 201, 202 from FIG. 2, where a bar magnet blank 401, shown in cross-section, is sliced by cuts (e.g., 402) and/or grinding to remove waste elements 403, which may not survive the process, and leave magnetic element 404. The bulk material of bar magnet blank 401 is suitable for use as a permanent magnet, but typically is not initially magnetized, at least not strongly (i.e., forming operations may take it above its Curie point). In cases where the bulk material of bar magnet blank 401 exhibits magnetic anisotropy, that is the material has one or more preferred axes for magnetization, then the easy axis should be aligned (that is, parallel with) with the arrow as show. This would be the case, for example, with a neodymium rare-earth magnet created with the sintered magnet process, wherein application of a magnetic field and/or mechanical deformation is applied to align anisotropic crystalline grains prior to a liquid-phase sintering that produces blank 401. After a grinding and/or cutting away of the waste elements (e.g., 403) to achieve the final shape and orientation of magnetic element 404, element 404 is typically electroplated or otherwise covered to protect the bulk material from corrosion, and the element 404 is magnetized in the direction of the arrow. Once magnetized, magnetic element 404 is suitable for inclusion in the magnet arrays of embodiments of the present invention, e.g., 200.

Figure 5:
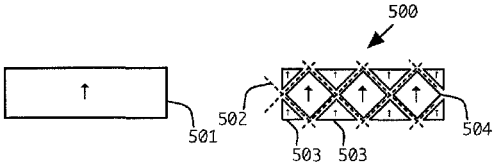
FIG. 5 is a cross-section of a sheet magnet and the cuts made in another process of forming the magnetic elements of embodiments of the present invention.

FIG. 5 shows a similar bar magnet manufacturing process 500 for making the individual magnetic elements, e.g., 201 and 202, wherein a bar magnet blank 501 is cut (e.g., 502) to remove waste elements 503, 504 and to separate magnetic elements 504, which may be further ground and coated (e.g., by electroplating or painting) and then magnetized.

In still another process for manufacturing the individual magnetic elements 201, 202, a magnetic material as a powder or slurry may be formed into the final or near-final shape (e.g., having the square cross-section of elements such as 201, 202) and sintered, without need for subsequent cutting to reshape the cross-section. A magnetic field may be applied during sintering to induce anisotropic grains to at least partially align their easy axis with the field, the applied field running parallel to the with the arrow as shown (e.g., in the individual magnetic elements 201, 202 in FIG. 2, but not as shown together as magnet array 200. Applying such a field during forming and/or sintering improves the final saturation magnetization along the axis parallel to the arrow as shown. The surfaces resulting from the sintering step may be smoothed by grinding and/or protected by coating, if desired. Once formed and cool (below their Curie temperature), the elements are magnetized along the indicated diagonal axis. One particular advantage of this process is that there is far less waste of magnetic material, since no large waste elements 403, 503 are cut away.

Figure 6A:
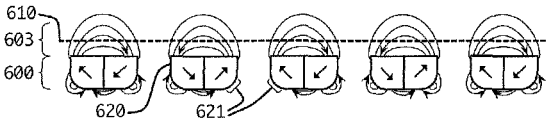
FIG. 6A is a cross-section showing a planar magnetic array and acoustic transducer diaphragm of embodiments of the present invention the magnetic array comprising multiple element pairs spaced to provide, acoustic transparency.

FIG. 6A shows, in cross-section, a compound planar magnetic array 600 comprising multiple magnetic array pairs 620, similar to 200. The planar magnetic field 603 is suitable for interaction with an electro-acoustic transducer diaphragm located in plane 610. The gaps between individual magnetic array pairs 620 allow transmission of sound. In some embodiments, the magnetic elements of each pair may be further shaped, e.g., by additional grinding during manufacturing process 400 or 500 before coating, so as to produce curved regions 621. This reduces the diffraction effects on sound propagating between the magnetic array pairs 620, as taught in U.S. Patent Application No. 61/892,417, filed Oct. 17, 2013, and entitled "Anti-Diffraction and Phase Correction Structure for Planar Magnetic Transducers" by Colich. In another embodiment, the individual magnetic elements of magnetic array pairs 620 can be manufactured through the process described above, in which the magnetic material as a powder or slurry is molded or die pressed into the final or near-final cross-sectional shape, as shown, where the curved regions 621 are created as the piece is formed and sintered.

Figure 6B:
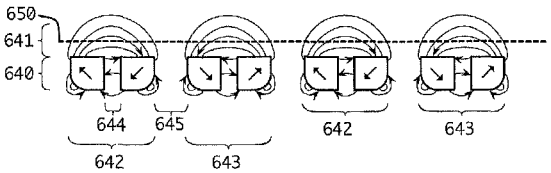
FIG. 6B is a cross-section showing a similar planar magnetic array, but with an additional air gap between the bar magnets of each pair.

In another embodiment, shown in FIG. 6B, planar magnetic array 640, comprises magnetic array pairs, e.g., 642, each of which encompasses an intra-pair air gap 644 between the individual bar magnets of the pair. As with array 600, consecutive pairs are separated by an inter-pair air gap 645. The intra-pair air gap 644 may be the same size as the inter-pair air gap 645, i.e., so all the gaps are identical, or smaller. The intra-pair gaps 644 improve the transmission of sound through the planar magnetic array. Note that, as in FIG. 6A, adjacent pairs, e.g., 642 and 643, have corresponding bar magnets of opposite magnetic orientation. An electro-acoustic diaphragm 650 is positioned in magnetic field 641 provided by the array 640.

Figure 7A:
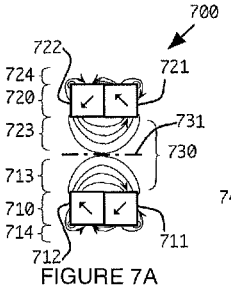
FIG. 7A is a cross-section of a magnetic array comprising two of magnetic array element pairs of FIG. 2, arranged in opposition with an acoustic transducer diaphragm positioned between them.

FIG. 7A shows dual magnetic array 700 comprises two opposed magnet array pairs 710, 720, each similar to 200 or 620. The lower magnetic array pair 710 comprises bar magnets 711, 712, shown in cross-section. Each bar magnet 711, 712 is magnetized with a field orientation as shown by the corresponding internal arrow. The combination of the two bar magnets 711, 712 produces a reinforced field 713 on a first side of the array and a nearly-canceled field 714 on a second, opposite side of the array 710. Likewise, the upper magnetic array pair 720 comprises bar magnets 721, 722, shown in cross-section. Each bar magnet 721, 722 is magnetized with a field orientation as shown by the corresponding internal arrow. The combination of the two bar magnets 721, 722 produces a reinforced field 723 on a first side of the array facing the lower magnetic array 710, and a nearly-canceled field 724 on a second, opposite side of the array 720.

Whereas in FIG. 2, the reinforced field 203 was roughly twice as strong as the field projected by either bar magnet 201, 202 operating alone, in the configuration of FIG. 7, the opposing reinforced fields 713, 723 combine to produce an combined field 730 roughly four times as strong as the field projected by any of the bar magnets 711, 712, 721, 722 operating alone.

In this configuration, placement of an electro-acoustic transducer diaphragm is along the plane of centerline 731.

Figure 7B:
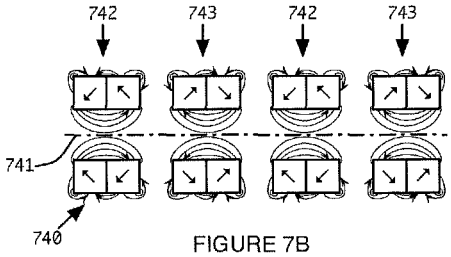
FIG. 7B is a cross-section of a magnetic array comprising multiple arrays such as in FIG. 7A, addressing a larger diaphragm.

The dual magnet array 700 can be repeated according to the pattern of planar magnetic array 640 in FIG. 6B, to accommodate wider diaphragms, as shown in FIG. 7B where extended dual magnetic array 740 comprises multiple arrays 742, similar to 700, alternating with mirrored arrays 743 in which each corresponding element having an opposite magnetization compared to arrays 742. Array 740 is able to address a larger diaphragm along centerline 741.

Figure 8:
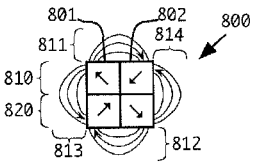
FIG. 8 is a cross-section of a magnetic array comprising two of the magnetic array element pairs of FIG. 2, closely packed, to provide an intensified field on all four sides.

FIG. 8 shows another magnetic array 800 comprising two magnetic array pairs 810, 820, each like 200. The upper magnetic array pair 810 comprises bar magnets 801, 802, and the lower magnetic array pair 820 is similarly constructed. Each of the bar magnets (e.g., 801) is magnetized with a field orientation as shown by the corresponding internal arrow. Upper pair 810 produces reinforced field 811 and while lower pair 820 produces reinforced field 812. However, the combination of the two pairs 810, 820 further produces reinforced side fields 813, 814. The nearly-canceled field 204, shown in FIG. 2, is present for each of pairs 810, 820, but in the configuration of four-magnet array 800, they are internal and provide a binding force to hold these individual magnets stably together.

Figure 9:
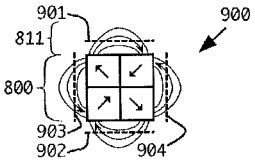
FIG. 9 is a cross-section of the same array of FIG. 8, showing the placement of four acoustic transducer diaphragms.

FIG. 9 shows the use of four-magnet array 800 in an electro-acoustic transducer 900, where diaphragms 901-904 are positioned in each corresponding magnetic field 811-814. Such a configuration is useful as a microphone with particular sensitivity in four directions, which can be kept as four separate electrical signals representing sound from each of the four directional lobes. If desired, such signals can be separately delayed, filtered, and summed or differenced as needed to provide fewer signals, each representing an adjusted directional sensitivity.

Figure 10:
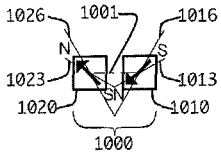
FIG. 10 shows the range of directions for the magnetic axes in a magnetic array element pair of embodiments of the present invention.

FIG. 10 shows a cross-section of a single magnetic array element pair 1000 of embodiments of the present invention, the elements 1010, 1020 of the pair being substantially coplanar bar magnets (i.e., the two bar magnets are parallel), the pair 1000 having a central plane 1001. The magnetic axis of the first bar magnet 1010 lying within limits 1013 (30° inclined to the plane 1001) and 1016 (60° inclined to the plane 1001), with 45° being the middle of this range. The magnetic axis of the second bar magnet 1020 lying within limits 1023 (30° inclined to the plane 1001) and 1026 (60° inclined to the plane 1001), likewise with 45° being the middle of this range. The two magnetic axes of the pair thus having a mutual angle of between 60° and 120° degrees, with 120° corresponding to both axes being close to the shallow 30° angle limits 1013, 1023 and 60° corresponding to both axes being close to the steeper 60° angle limits 1016, 1026. With both axes near the 45° mid-range angle relative to the central plane 1001, their mutual angle will be about 90°. The mid-range value of 45° with the mutual angle of about 90° is near optimal when there is no gap between bar magnets 1010 and 1020 and the magnets are square in cross-section.

Various additional modifications of the described embodiments of the invention specifically illustrated and discussed herein will be apparent to those skilled in the art, particularly in light of the teachings of embodiments of this invention. It is intended that embodiments of the invention cover all modifications and embodiments, which fall within the spirit and scope of embodiments of the invention. Thus, while preferred embodiments of the present invention have been disclosed, it will be appreciated that it is not limited thereto but may be otherwise embodied within the scope of the following claims.

I claims:

1. A magnet array comprising:

at least one pair of consecutive, parallel bar magnets, each pair comprising a parallel first and second bar magnet having a central plane between them, each bar magnet having a corresponding magnetic field having a direction perpendicular to the long axis of the bar magnet and between 30° and 60° inclined to the central plane, the direction of the magnetic field establishing a corresponding north and south poles of the bar magnet;

each pair of bar magnets configured with the north pole of the first magnet being closer to the south pole of the second magnet than to the north pole of the second magnet, each pair of bar magnets having the direction of the magnetic field of the first bar magnet at an angle between 60° and 120° relative to the direction of the magnetic field of the second bar magnet;

wherein the corresponding magnetic field formed on a first side of each pair between the north pole of the corresponding second magnet and the south pole of the corresponding first magnet is reinforced.

2. The magnet array of claim 1 wherein the corresponding magnetic field formed on a second side of each pair opposite the first side is nearly canceled.

3. The magnet array of claim 1 wherein the at least one pair of consecutive bar magnets comprises a first plurality of pairs of consecutive bar magnets, the pairs of the first plurality being substantially parallel and arrayed in a first plane, each pair of the first plurality having the corresponding first side commonly oriented, each consecutive pair of the first plurality having a mirrored orientation, such that one pole of one magnet in a first one of the consecutive pair is nearest the like pole of the like magnet of the second one of the consecutive pair.

4. The magnet array of claim 3 wherein the consecutive pairs of bar magnets are separated by a first gap.

5. The magnet array of claim 4 wherein the bar magnets of each pair are separated by a second gap.

6. The magnet array of claim 5 wherein the first gap and the second gap are the same size.

7. The magnet array of claim 3 wherein the at least one pair of consecutive bar magnets further comprises a second plurality of pairs of consecutive bar magnets, the pairs of the second plurality being substantially parallel to the magnets of the first plurality and arrayed in a second plane, the second plane parallel to and the first plane, the first plurality and the second plurality separated by a gap each pair of the second plurality having the corresponding first commonly oriented, each consecutive pair of the second plurality having a mirrored orientation, such that one pole of one magnet in a first one of the consecutive pair is nearest the like pole of the like magnet of the second one of the consecutive pair, wherein the first sides of the pairs of first and second pluralities face each other to produce a planar opposed reinforced magnetic field.

8. The magnet array of claim 1 wherein the at least one pair of consecutive bar magnets comprises at least two opposed pairs of consecutive bar magnets, separated by a gap, the south pole of the first magnet of a first one of each opposed pair being nearest the south pole of the first magnet of another one of each opposed pair, and, the north pole of the second magnet of the first one of each opposed pair being nearest the north pole of the second magnet of the other one of each opposed pair.

9. The magnet array of claim 1 wherein the at least one pair of consecutive bar magnets is two pairs of consecutive bar magnets, the two pairs aligned and oriented with the corresponding second sides facing each other and the north poles of the first magnet of each pair oppositely oriented.

10. The magnet array of claim 1 wherein at least one of the first and second bar magnets of each pair comprises a rounded portion; whereby the rounded portion reduces the effects of diffraction on sound propagating between the magnetic array pairs.

* * * * *